United States Patent [19]

Rothman

[11] Patent Number: 4,635,913

[45] Date of Patent: Jan. 13, 1987

[54] PORTABLE SURGICAL DRAINAGE PLATFORM

[76] Inventor: Michael L. Rothman, 440 St. Michaels Dr., Santa Fe, N. Mex. 87501

[21] Appl. No.: 792,544

[22] Filed: Oct. 29, 1985

[51] Int. Cl.[4] ..... A61G 13/00

[52] U.S. Cl. ..... 269/327

[58] Field of Search ..... 269/327, 328, 15, 325; 312/229; 211/126, 127, 41; 220/1 C, 8, 4 B, 22.1, DIG. 6

[56] References Cited

U.S. PATENT DOCUMENTS

| | | | |
|---|---|---|---|
| D. 168,945 | 3/1953 | Liskey . | |
| 1,796,493 | 3/1931 | Thompson | 269/327 |
| 1,976,100 | 10/1934 | Spriggs et al. | 269/327 |
| 2,794,694 | 6/1957 | Fullwood et al. | 269/325 |
| 2,851,311 | 9/1958 | Gibbs . | |
| 4,243,214 | 1/1981 | La Rooka | 269/327 |

*Primary Examiner*—Robert C. Watson

*Attorney, Agent, or Firm*—Kelly, Bauersfeld, & Lowry

[57] ABSTRACT

A readily cleaned and sterilized drainage platform for collecting fluids discarded during surgical operations includes a collection basin having three support trays. The two other or wing support trays are attached by overlapping hinges to a central support tray for convenient folding of the platform. When folded, the platform can be easily stored or, by extending a set of retractable rollers on the underside of the central support tray, can be readily moved within or between operating rooms. The drainage platform provides a confortable non-slip surface upon which several medical personnel may stand during an operation, and, for the convenience of the surgeon, also provides adjustable instrument trays.

18 Claims, 18 Drawing Figures

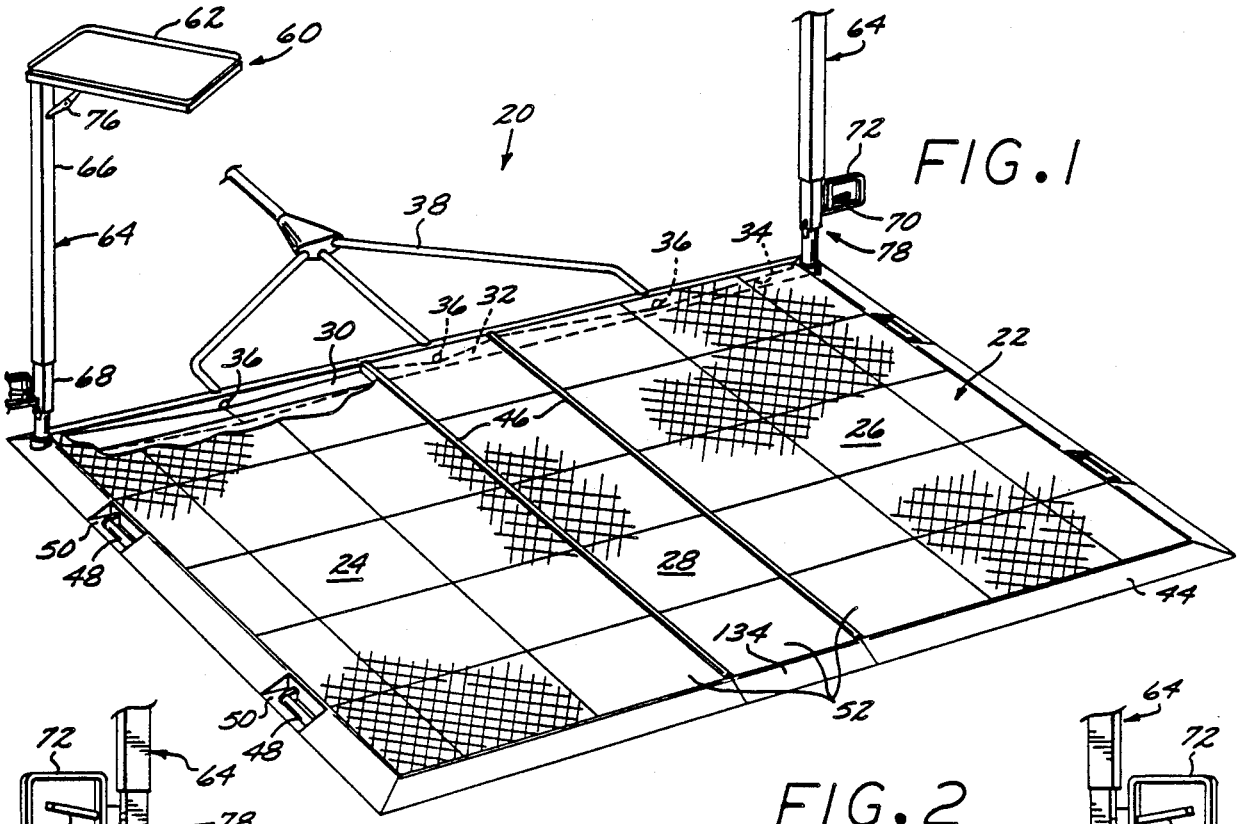
FIG. 1
FIG. 2
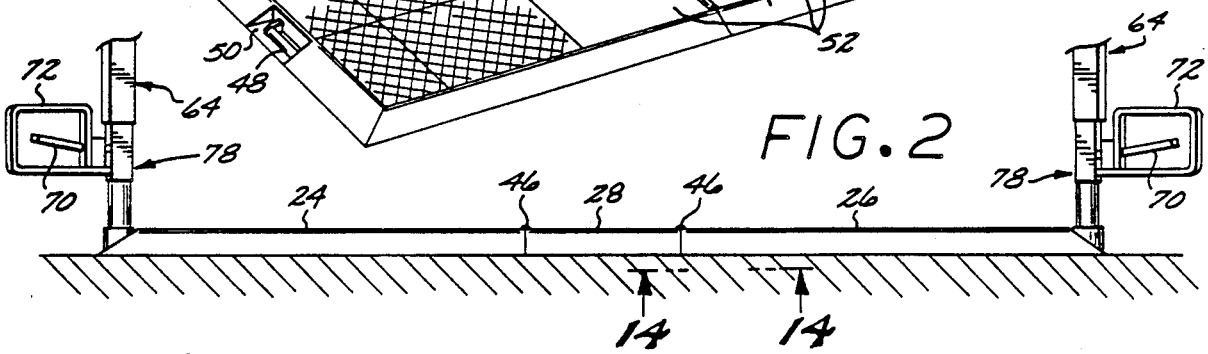
FIG. 3
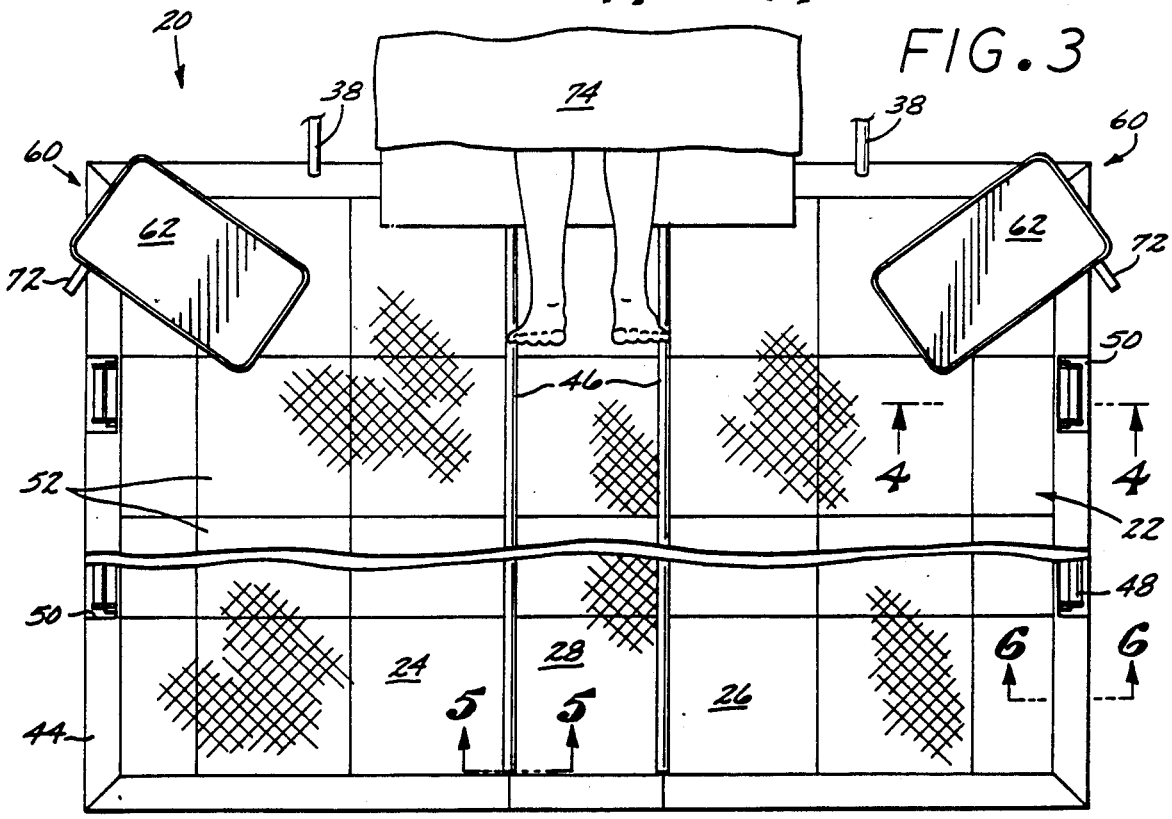

FIG. 13
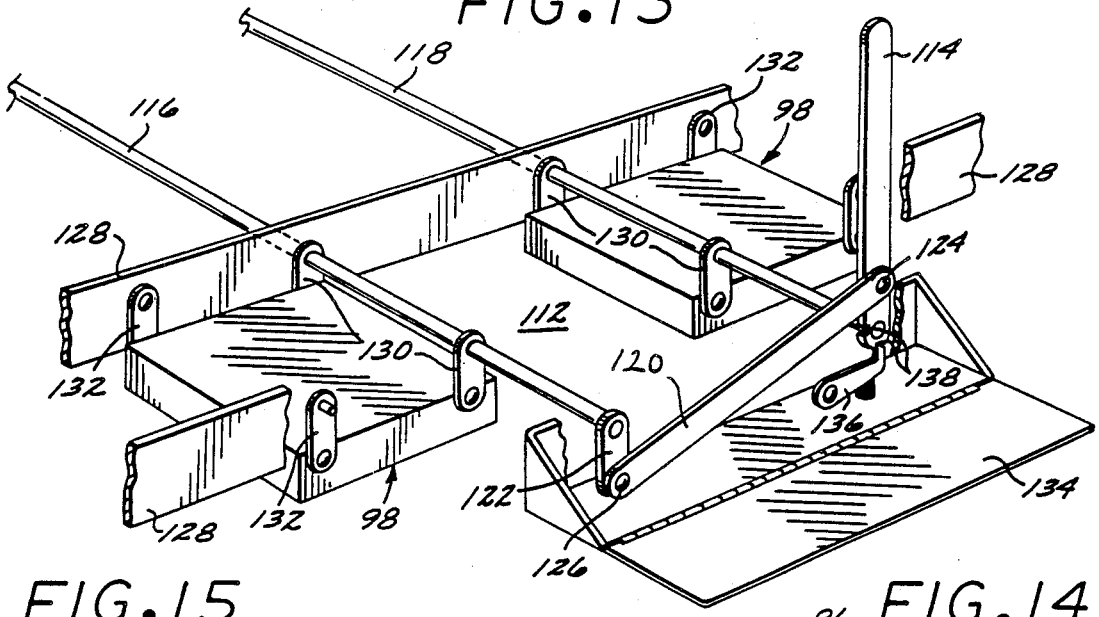
FIG. 15
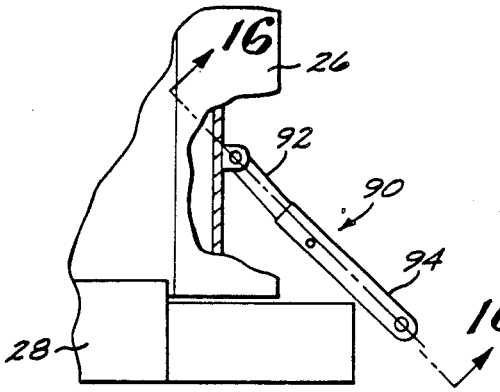
FIG. 14
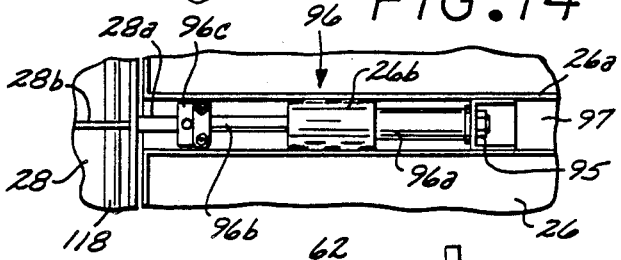
FIG. 16
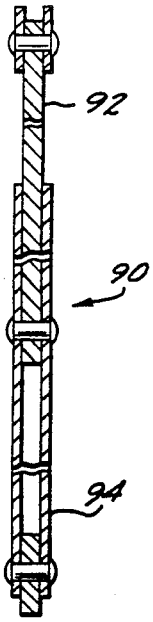
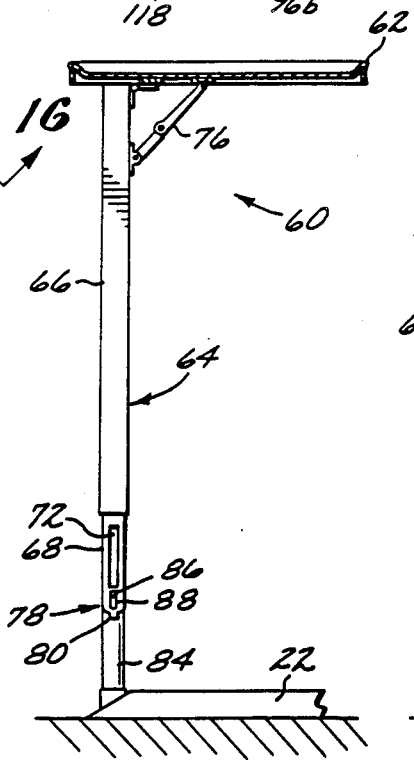
FIG. 17
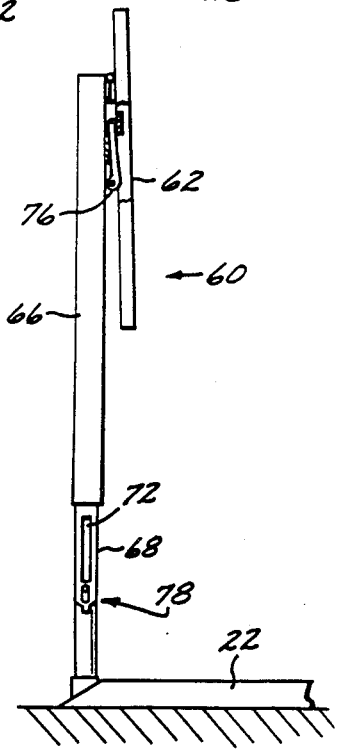
FIG. 18

PORTABLE SURGICAL DRAINAGE PLATFORM

BACKGROUND OF THE INVENTION

This invention relates generally to devices utilized during surgical operations, and, more particularly, to devices for collecting fluids discarded during surgical operations which prevent such fluids from pooling on an operating room floor and creating a hazardous condition for operating room personnel.

Many types of surgical operations involve large quantities of fluids. For example, arthroscopic surgery often requires large quantities of saline solution for cleansing and irrigating the injured area. Trauma surgery similarly requires large quantities of saline solution, but in addition large quantities of blood will usually flow from the traumatized area. In the past these fluids have been allowed to fall onto the floor surrounding an operating table, causing the floor to become excessively slippery and posing a hazardous condition for operating room personnel by increasing the risk of falling or slipping. Furthermore, the shoes and feet of operating room personnel become soaked by the fluids, which can be uncomfortable and distracting.

A simple solution for alleviating this hazardous condition is to provide a grating or a rigid platform upon which operating room personnel may stand. This is not satisfactory in many instances, and can even create additional problems. For example, a grating or rigid platform does not alleviate the hazard posed by the slippery operating room floor unless the entire floor is covered with the grating or platform. Such a solution is not satisfactory, however, since an entire floor covered with a grating or rigid platform is prohibitively costly. Furthermore, the provision of a grating or rigid platform does not lessen the task of cleaning the operating room after the surgery is completed, nor is such a grating or rigid platform easily moved, sterilized or stored.

Accordingly, there has been a long existing need in the medical field for a device which collects fluids discarded during surgical operations, which fluids would otherwise be allowed to pool on the operating room floor and create a hazardous condition for operating room personnel. The device must be easily cleaned and sterilized, as well as be portable for movement within and between operating rooms. Furthermore, the device should prevent the shoes and feet of operating room personnel from becoming wet during the operation, be comfortable to stand on for prolonged periods of time, and provide operating room personnel easy access to surgical tools and instruments. The present invention fulfills these needs and provides other related advantages.

SUMMARY OF THE INVENTION

The present invention resides in a portable surgical drainage platform for collecting fluids discarded during surgical operations. The surgical drainage platform generally comprises a collection basin having three support trays. The two outer or wing support trays are attached by overlapping hinges to a central support tray for convenient folding of the platform. When folded, the platform can be easily stored or, by extending a set of retractable wheels or rollers on the underside of the central support tray, can be readily moved within or between operating rooms.

When the surgical drainage platform is to be used during an operation, the drainage platform is moved into an operating room in its folded configuration and positioned adjacent an operating table, and then the wing support trays are extended horizontally. The rollers are then retracted to set the platform squarely on the floor, and perforated PVC mats, which are lightweight and elastic, are placed in the collection basin. The PVC mats are perforated to allow the discarded fluids to fall through the mats and into the collection basin. Because the mats are elastic, they provide a comfortable platform upon which a surgeon and one or more assistants stand during the operation. The mats can be removed and independently sterilized as desired.

The collection basin has a slight downward slant toward the front of the platform to carry fluids into narrow troughs at the front of the three support trays. The troughs can be evacuated during or after the operation by connecting a drain in each of the troughs, through external tubing, to any conventional suction device provided in the operating room. The support trays are attached to each other by overlapping hinges to prevent any fluids from leaking onto the floor between the support trays, and one or more instrument trays can be placed at the corners of the platform.

The retractable rollers are interconnected by a linkage mechanism that permits them all to be extended or retracted simultaneously by a single lever at the rear of the platform. When the platform is folded, the rollers are normally extended so that the platform can be easily moved. When the platform is unfolded for use during an operation, the wheels initially remain extended so that the platform can be easily maneuvered under the area of the operation to maximizing fluid collection, and then are retracted to allow the platform to rest securely on the operating room floor, providing a stable platform upon which to stand.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a rear perspective view of a portable surgical drainage platform embodying the invention, shown resting upon an operating room floor with the outer or wing support trays extended, and being connected to suction tubing;

FIG. 2 is a rear elevational view of the portable surgical drainage platform illustrated in FIG. 1;

FIG. 3 is a fragmented top plan view of the portable surgical drainage platform illustrated in FIG. 1, showing how it might be positioned to collect fluids during surgery on a patient's lower extremities;

FIG. 13 is a fragmented perspective view of a linkage mechanism for retracting and extending the retractable wheels or rollers;

FIG. 14 is a fragmented view taken generally along the line 14—14 of FIG. 2, illustrating a gas cylinder which functions as a damper for preventing the outer support trays from falling too rapidly when the platform is unfolded;

FIG. 15 is an enlarged, fragmented view taken generally of the area 15 of FIG. 10, illustrating a locking bar for locking the outer support trays into a vertical position;

FIG. 16 is an enlarged, fragmented sectional view taken generally along the line 16—16 of FIG. 15;

FIG. 17 is an elevational view of an instrument tray, with the tray in cross-section, showing how it might be positioned during surgery to hold surgical instruments; and FIG. 18 is an elevational view of the instrument tray illustrated in FIG. 17, with the exception that the tray is folded.

DETAILED DESCRIPTION OF THE PREFERRED EMBODIMENT

Figure 4:
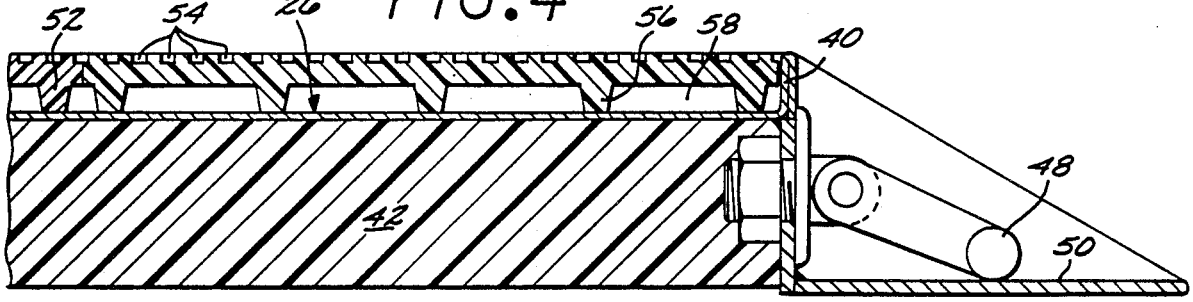
FIG. 4 is an enlarged, fragmented sectional view taken generally along the line 4—4 of FIG. 3.

As shown in the drawings for purposes of illustration, the present invention is embodied in a novel surgical drainage platform, generally designated by reference number 20, which is designed to collect fluids discarded during surgical operations, which fluids would otherwise be allowed to pool on an operating room floor and create a hazardous condition for operating room personnel. The drainage platform 20 is readily portable for movement within and between operating rooms, and provides a comfortable platform upon which a surgeon and one or more assistants may stand during an operation.

In accordance with a preferred embodiment of the invention, the surgical drainage platform 20 forms a collection basin 22 and includes two outer or wing support trays 24 and 26, and a central support tray 28. The collection basin 22 has a slight downward slant toward the front of the platform 20 to carry the fluids that fall into the collection basin 22 into narrow troughs 30, 32 and 34 at the front of the three support trays 24, 26 and 28 (FIG. 1). The troughs 30, 32 and 34 can be drained during or after an operation by connecting a drain 36 at the bottom of each trough, through external tubing 38, to any conventional suction device (not shown) typically provided in an operating room for suctioning fluids.

Figure 5:
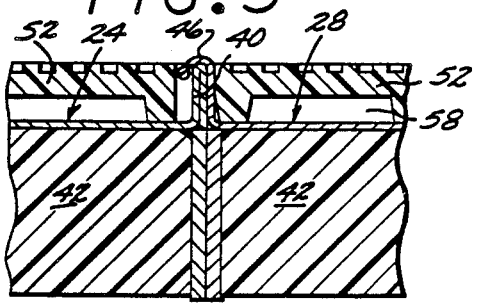
FIG. 5 is an enlarged, fragmented sectional view taken generally along the line 5—5 of FIG. 3, illustrating the overlapping hinge arrangement between adjacent support trays.
Figure 6:
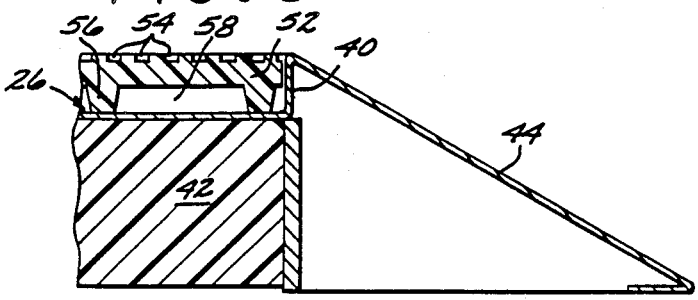
FIG. 6 is an enlarged, fragmented sectional view taken generally along the line 6—6 of FIG. 3.

Each of the three support trays 24, 26 and 28 is constructed from a single sheet of a lightweight, strong material, such as aluminum. A rim 40 is formed around the entire perimeter of each sheet of material to create the basin of each support tray as shown in FIGS. 4 through 6. A light-weight, dense foam padding 42 underlies each support tray 24, 26 and 28 to provide support for the tray when operating room personnel stand on the drainage platform 20 during an operation. A canted edge 44 is formed in each sheet of material to form an outer perimeter of the drainage platform 20 (FIGS. 1, 3 and 6), which canted edge reduces the likelihood of operating room personnel tripping on the edge of the drainage platform.

The two outer support trays 24 and 26 are attached by overlapping hinges 46 to the center support tray 28 for convenient folding of the platform 20. When the platform 20 is folded, it can be easily stored or readily moved between operating rooms. A set of recessed handles 48, rotatably attached to the sides of the collection basin 22, allow for easy folding and unfolding of the platform 20. As shown best in FIG. 4, the handles 48 are rotatably attached to the sides of the platform 20 in recessed areas 50. When the platform 20 is extended horizontally for use during an operation, the handles 48 rotate downwardly and rest on the floor of the recessed areas 50.

The hinges 46 are overlapping to prevent any fluids from leaking onto the operating room floor between the support trays 24, 26 and 28. In addition, the overlapping hinges 46 span the entire length of the platform 20 (FIGS. 1, 3 and 5).

Placed in the collection basin 22 over the upper sheets of the support trays 24, 26 and 28, are perforated, lightweight and elastic mats 52, preferably formed of a PVC material. The PVC mats 52 are perforated to allow the discarded fluids to fall through the mats and into the collection basin 22. The PVC mats 52 are elastic to provide a comfortable platform upon which a surgeon and one or more assistants stand during an operation, and can be removed and independently sterilized as desired.

More specifically, and as shown in FIG. 4, the mats 52 have perforations 54 that allow the fluids falling onto the mats to fall through the mats and into the collection basin 22. The undersides of the mats 52 have small stubs or protuberances 56, thus providing a clearance 58 between the mats 52 and the floor of the collection basin 22 (this floor being the upper sheets of the support trays 24, 26 and 28). This clearance 58 allows the fluids falling into the collection basin 22 to flow substantially unimpeded by the mats 52 toward the front of the platform 20 and into the troughs 30, 32 and 34 for subsequent evacuation and/or disposal.

One or more instrument trays 60 can be placed at the corners of the platform 20 for the convenience of the surgeon and other medical personnel. As shown in FIGS. 17 and 18, the instrument trays 60 include a removable tray 62 and a height-adjustable stand 64. The height-adjustable stand 64 includes an upper tube 66 having inside dimensions slightly larger than the outside dimensions of a lower tube 68, thus allowing the upper tube to fit over the lower tube. The height of the stand 64 is adjusted by depressing a foot lever 70 (FIG. 2) which unlocks the height-adjustable stand and allows the upper tube to be moved up or down over the lower tube. Releasing the foot lever 70 locks the height-adjustable stand 64 to the desired height. The foot lever 70 is protected from being inadvertently depressed by a foot guard 72 forming a rectangular barrier. As shown in FIG. 3, the height-adjustable stands 64 can swivel 360 degrees about the vertical axis for placement of the removable trays 62 in any convenient orientation with respect to a patient 74. Furthermore, the trays 62 are removable from the height-adjustable stands 64 for ease of cleaning and for the carrying of instruments about the operating room.

Figure 7:
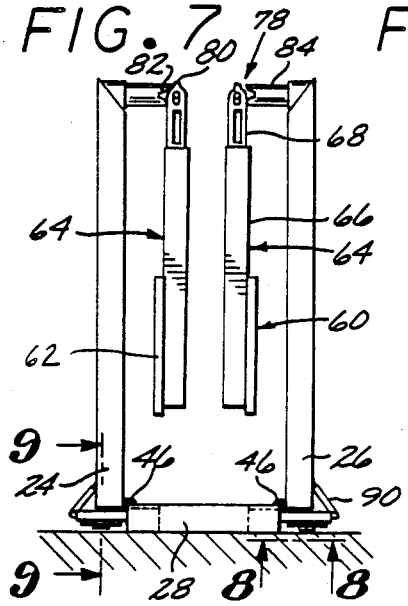
FIG. 7 is a rear elevational view of the portable surgical drainage platform, illustrating the configuration of the several support and instrument trays when the portable surgical drainage platform is folded.

The surgical drainage platform 20 of the present invention can be readily folded for storage or for convenient movement within or between operating rooms. To fold the platform 20, the instrument trays 60 must be folded first. To fold the instrument trays 60, an over-center locking bar 76, which supports the removable tray 62 in a horizontal position during use, must be unlocked. Once unlocked, the removable tray 62 can be pivoted from the horizontal to the vertical position as shown in FIGS. 17 and 18. The height-adjustable stand 64 can then be pivoted about a slip-lock joint 78, as shown in FIG. 7.

The slip-lock joint 78 includes a pair of downwardly-projecting locking stubs 80 and a pair of opposing detents 82, which engage the locking stubs when the slip-lock joint is in the locked position. The locking stubs 80 are disposed at the lower end and on opposite sides of the lower tube 68. The detents 82 are disposed at the upper end and on opposite sides of a base tube 84, which has its lower end attached to the platform 20. The upper end of the base tube 84 is pivotally attached to the lower end of the lower tube 68 by a pair of pivot stubs 86, which protrude outwardly from opposite sides of the upper portion of the base tube and engage a pair of vertical slots 88 in the lower portion of the lower tube 68. The slip-lock joint 78 is unlocked by lifting up on the height-adjustable stand 64 until the locking stubs 80 disengage the dentents 82. The height-adjustable stand 64 can then be pivoted about the pivot stubs 86 for convenient folding of the instrument tray 60.

Figure 10:
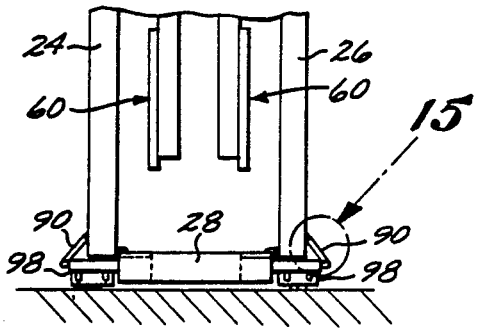
FIG. 10 is a rear fragmented elevational view of the folded portable surgical drainage platform similar to that shown in FIG. 7, with the exception that the retractable wheels or rollers are extended to raise the portable surgical drainage paltform off the floor for movement.

The two outer support trays 24 and 26 are locked into a vertical position when the platform 20 is folded, by over-center locking bar assemblies 90 at each corner of the central support tray 28. As shown in FIGS. 7 and 10, one end of the over-center locking bar assembly 90 is attached to the underside of an outer support tray 24 or 26, and the opposite end of the locking bar assembly is attached to the underside of the central support tray 28. Each over-center locking bar assembly 90 includes a flat bar 92 having an end pivotally attached to an outer platform tray 24 or 26, and an opposite end pivotally attached to an end of a channel bar 94. The other end of the channel bar 94 is pivotally attached to the central support tray 28 (FIGS. 15 and 16). The over-center locking bar assembly 90 locks into place when the flat bar 92 is rotated about 180 degrees with respect to the channel bar 94, and the flat bar rests against the inside surface of the channel bar.

A gas cylinder 96 is also attached between the central support tray 28 and each outer support tray 24 or 26, and is positioned about midway between the front and the rear of the platform 20 (FIG. 14). The illustrated gas cylinder 96 comprises a tube portion **96*a* and a rod portion 96*b*, and is situated generally within a channel 26*a* provided underside of the outer support tray 26. The tube portion 96*a* is secured by a nut 95 to an anchor 97 rigidly positioned within the channel 26*a*, and a protective cover 26*b* is further welded over the gas cylinder 96 within the channel 26*a*. The movable free end of the rod portion 96*b* is secured to a pivotable link 96*c* which, in turn, is pivotally connected to a tongue 28*a* extending outwardly from the central support tray 28. A brace 28*b* is provided the central support tray 28 opposite the tongue 28*a*. The gas cylinder 96 functions as a damper to prevent the two outer support trays 24 and 26 from falling too rapidly when the locking bar assemblies 90** are unlocked.

When the platform 20 is folded, as shown in FIG. 7, it can be easily and conveniently stored, and, by extending a set of retractable wheels or rollers 98 at each corner of the central support tray 28 (FIG. 10), the platform 20 can be readily moved about as well. The retractable rollers 98 can also be left extended when the platform 20 is unfolded, in order to maneuver the platform 20 under the area of the operation, thus maximizing fluid collection. When this maneuvering is complete, the rollers are retracted to allow the platform 20 to rest squarely on the operating room floor, providing a stable platform upon which medial personnel stand during an operation.

Figure 8:
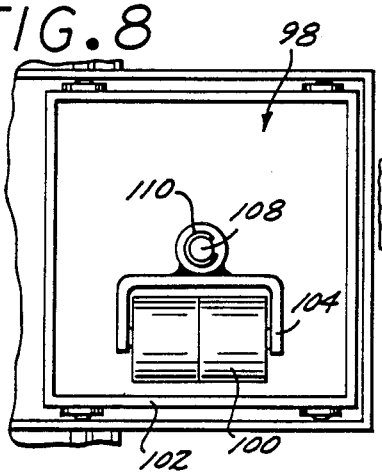
FIG. 8 is an enlarged, fragmented view taken generally along the line 8—8 of FIG. 7, illustrating a retractable wheel or roller.
Figure 9:
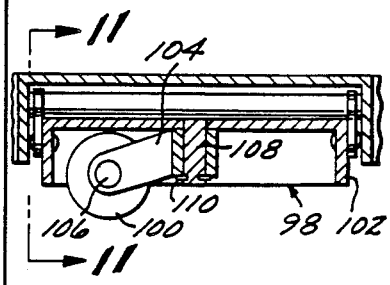
FIG. 9 is an enlarged, fragmented sectional view taken generally along the line 9—9 of FIG. 7.

As illustrated in FIGS. 8 and 9, the retractable rollers 98 include a wheel 100 attached to the inside top of an open-bottomed, rectangular metal box 102, thus providing a protective housing for the wheel. The wheel 100 is attached to the rectangular metal box 102 by a bracket 104. The wheel 100 is rotatably attached to the bracket 104 by an axle 106, which allows the wheel to turn freely on its roll axis. The bracket 104 is pivotally attached to the rectangular metal box 102 by a shaft 108, which extends downwardly from the center of the inside top of the metal box 102. The bracket 104 is held onto the shaft 108 by a retaining ring 110. The wheel 100 can rotate 360 degrees about the vertical axis, which provides a very tight turning capability when maneuvering the surgical drainage platform 20 in small spaces. The retractable rollers 98 are interconnected by a linkage mechanism 112 which permits the retractable rollers to be extended or retracted simultaneously by a single lever 114 at the rear of the drainage platform 20.

The linkage mechanism 112 includes the lever 114 and two parallel metal rods 116 and 118, which are rotated by the lever 114. Each metal rod 116 and 118 extends or retracts two of the retractable rollers 98. The lever 114 rotates the metal rod 118 about its longitudinal axis through a direct attachment of the lever at the end of the metal rod 116. The metal rod 116, on the other hand, is rotated by the lever 114 about its longitudinal axis through a connecting bar 120 and a pivot bar 122. The connecting bar 120 is pivotally attached at one end to the lever 114 at an attachment point 124, and is pivotally attached at the other end to the pivot bar 122 at another attachment point 126. The opposite end of the pivot bar 122 is rigidly attached at the end of the metal rod 116. The attachment point 124 is chosen such that the distance between the attachment point 124 and the longitudinal axis of the metal rod 118 is equal to the distance between the other attachment point 126 and the longitudinal axis of the metal rod 116, thus providing equal moment arms about the two longitudinal axes.

Figure 11:
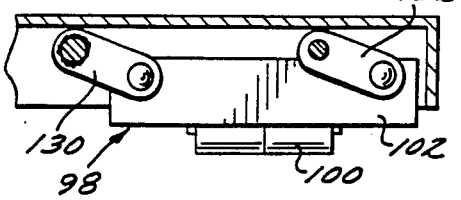
FIG. 11 is an enlarged, fragmented view taken generally along the line 11—11 of FIG. 9, illustrating the retractable wheel or roller in a raised or retracted position.
Figure 12:
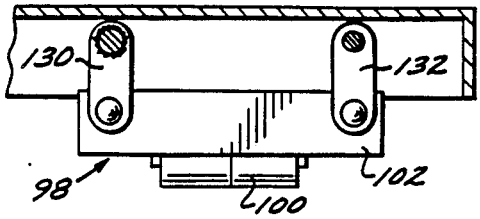
FIG. 12 is a view similar to FIG. 11, illustrating the retractable wheel or roller in a lowered or extended position.

The metal rods 116 and 118, which are supported by frame members 128 in the central support tray 28, extend or retract the individual retractable rollers 98 through pivot bars 130. Each retractable roller 98 has two pivot bars 130 with ends pivotally attached at two corners of the retractable roller 98. The other ends of the pivot bars 130 are rigidly attached to the metal rods 116 and 118. As the metal rods 116 and 118 rotate, the pivot bars 130 also rotate about the rigid attachment point and extend or retract the retractable rollers 98, as shown in FIGS. 11 and 12. The other two corners of the retractable roller 98 are supported by support bars 132. Each support bar 132 has an end pivotally attached to the frame member 128 and an end pivotally attached to the retractable roller 98.

When the retractable rollers 98 are in the retracted position, the lever 114 is in a horizontal position and is enclosed within the canted edge 44 at the rear of the drainage platform 20. As shown in FIG. 13, a hinged cover plate 134 provides access to the lever 114. When the lever 114 is in the vertical or upright position, the retratable rollers 98 are in the extended position and the platform 20 can be readily moved. The lever 114 is held in either the retracted or extended position by a spring-loaded catch 136, which engages either of two detents 138 in the lever 114.

From the foregoing it is to be appreciated that the present invention provides a novel surgical drainage platform for collecting fluids discarded during surgical operations. When folded, the platform can be easily stored or, by extending a set of retractable rollers, can be readily moved about. When in use, the drainage platform provides a comfortable surface upon which a surgeon and one or more assistants stand during an operation. Furthermore, the platform can be easily cleaned and sterilized.

Although a particular embodiment of the invention has been described in detail for purposes of illustration, various modifications can be made without departing from the spirit and scope of the invention. Accordingly, the invention is not to be limited, except as by the following claims.

I claim:

1. A portable surgical drainage platform for collecting fluids discarded during surgical operations, said platform comprising:

a central support tray and two outer support trays situated adjacent opposite edges of said central support tray, each of said support trays including a trough at one end, an upper fluid receiving surface having a slight inclination for channeling fluids toward and into said trough, a drain for evacuating fluids from said trough, and means situated below said upper fluid receiving surface for supporting the same;

means for rotatably attaching said outer support trays to said central support tray, said attaching means including overlapping hinges to prevent fluid from leaking between said outer support trays and said central support tray;

means for locking each said outer support tray in a folded position when rotated about said attaching means with respect to said central support tray;

means for damping the downward movement of each said outer support tray when unfolded to align said outer support trays with said central support tray;

a plurality of removable perforated mats, said mats being situated upon said upper fluid receiving surfaces of said support trays to provide a non-slip surface through which fluids may pass; and means for moving said platform, said moving means including a plurality of vertically extendable and retractable roller mechanisms situated below said upper fluid receiving surface of said central support tray, a hand lever which can be releasably locked in one of two primary positions, and means for extending or retracting all said roller mechanisms simultaneously in response to the positioning of said hand lever to, respectively, raise or lower said platform.

2. A platform as set forth in claim 1, including means for mounting an instrument tray to at least one of said support trays, and an instrument tray secured to said platform by said mounting means.

3. A platform as set forth in claim 2, wherein said instrument tray can be folded and stored with said platform when said outer support trays are also folded.

4. A portable surgical drainage platform for collecting fluids discarded during surgical operations, said platform comprising:

a collection basin for receiving discarded fluids, said collection basin providing an upper perforated, non-skid surface, and a lower fluid impermeable reservoir;

a plurality of support trays rotatably attached to one another to form said collection basin;

means for preventing fluid from leaking between adjacent ones of said trays; and means for moving said collection basin, said moving means including a plurality of vertically extendable and retractable roller mechanisms, and means for extending or retracting all said roller mechanisms simultaneously.

5. A platform as set forth in claim 4, wherein said plurality of support trays include a central tray and at least one outer tray.

6. A platform as set forth in claim 5, including means for locking said outer tray in a folded position when rotated about its attachment to said central tray, and means for damping the downward movement of said outer tray when unfolded to align said outer tray with said central tray.

7. A platform as set forth in claim 4, wherein said upper perforated, non-skid surface includes a plurality of removable mats situated upon and supported by said lower fluid impermeable reservoir.

8. A platform as set forth in claim 4, including means for mounting an instrument tray to said collection basin, and an instrument tray secured to said platform by said mounting means.

9. A portable surgical drainage platform for collecting fluids discarded during surgical operations, said platform comprising:

a central support tray having a central tray upper fluid receiving and containing surface;

a plurality of outer support trays, each said outer support tray having an outer tray upper fluid receiving and containing surface;

means for rotatably attaching said central and outer support trays, said attaching means including means for preventing fluid from leaking between adjacent ones of said trays;

a removable, perforated mat situated upon said upper fluid receiving and containing surface of each said tray, said mat providing a non-skid surface through which fluids may pass; and means for moving said trays, said moving means including a plurality of vertically extendable and retractable roller mechanisms associated with said central support tray, and means for extending or retracting all said roller mechanisms simultaneously.

10. A platform as set forth in claim 9, wherein said central support tray and said outer support trays each include a trough generally situated at one end of said platform, and wherein said fluid receiving and containing surface of each said tray has a slight inclination for channeling fluids toward and into said trough.

11. A platform as set forth in claim 10, including drains for evacuating fluids from said troughs.

12. A platform as set forth in claim 9, wherein at least one of said outer support trays is situated along an opposite edge of said central support tray with respect to another one of said outer support trays.

13. A platform as set forth in claim 9, wherein said means for preventing fluid from leaking between adjacent ones of said trays includes an overlapping hinge.

14. A platform as set forth in claim 9, including means for locking said outer support trays in a folded position with respect to said central support tray.

15. A platform as set forth in claim 9, including means for damping the downward movement of said outer support trays when unfolded to align said outer support trays with said central support tray.

16. A platform as set forth in claim 9, wherein said moving means includes a hand lever which can be releasably locked in one of two primary positions, said hand lever actuating said means for extending or retracting all said roller mechanisms simultaneously.

17. A platform as set forth in claim 9, including means for mounting an instrument tray to at least one of said support trays, and an instrument tray secured to said platform by said mounting means.

18. A platform as set forth in claim 9, wherein said instrument tray can be folded and stored with said platform when said outer support trays are also folded.

* * * * *

UNITED STATES PATENT AND TRADEMARK OFFICE

CERTIFICATE OF CORRECTION

PATENT NO. : 4,635,913

DATED : January 13, 1987

INVENTOR(S) : Michael L. Rothman

It is certified that error appears in the above-identified patent and that said Letters Patent is hereby corrected as shown below:

In the Abstract line 4, delete the word "other" and insert therefor--outer--.

In the Abstract, line 10, delete the word "confortable" and insert therefor--comfortable--.

In Column 5, line 3, delete the word "stands" and insert therefor--stand--.

In Column 5, line 37, delete the word "dentents" and insert therefor--detents--.

In Column 6, line 20, delete the word "medial" and insert therefor--medical--.

In Column 7, line 14, delete the word "retratable" and insert therefor--retractable--.

In Column 10, line 14, delete the "9" and insert therefor--17--.

Signed and Sealed this

Twenty-ninth Day of December, 1987

*Attest:*

DONALD J. QUIGG

*Attesting Officer*

*Commissioner of Patents and Trademarks*